US008220271B2

(12) United States Patent
Poyyapakkam et al.

(10) Patent No.: US 8,220,271 B2
(45) Date of Patent: Jul. 17, 2012

(54) FUEL LANCE FOR A GAS TURBINE ENGINE INCLUDING OUTER HELICAL GROOVES

(75) Inventors: Madhavan Narasimhan Poyyapakkam, Mellingen (CH); Adnan Eroglu, Untersiggenthal (CH); Gregory John Kelsall, Broughton Astley (GB)

(73) Assignee: ALSTOM Technology Ltd., Baden (CH)

( * ) Notice: Subject to any disclaimer, the term of this patent is extended or adjusted under 35 U.S.C. 154(b) by 940 days.

(21) Appl. No.: 12/241,223

(22) Filed: Sep. 30, 2008

(65) Prior Publication Data

US 2010/0077756 A1 Apr. 1, 2010

(51) Int. Cl.
*F02C 1/00* (2006.01)
*F02G 3/00* (2006.01)

(52) U.S. Cl. ..... 60/740; 60/737; 60/742; 60/733

(58) Field of Classification Search ..... 431/159; 60/741, 734, 737, 743, 748, 746, 747, 800, 60/738, 740, 742; 239/500, 501, 556–559, 239/562, 567, 423–425, 426, 427, 427.3, 239/429–434
See application file for complete search history.

(56) References Cited

U.S. PATENT DOCUMENTS 1,866,311 A * 7/1932 Leiman ..... 239/406
2,701,164 A * 2/1955 Orent et al. ..... 239/400
3,510,064 A * 5/1970 Read et al. ..... 239/424
3,648,457 A 3/1972 Bobo
4,133,485 A * 1/1979 Bouvin ..... 239/399
4,258,544 A * 3/1981 Gebhart et al. ..... 60/800
4,457,241 A * 7/1984 Itse et al. ..... 110/347
4,603,548 A 8/1986 Ishibashi et al.
4,952,136 A * 8/1990 Collins et al. ..... 431/183
4,982,570 A 1/1991 Waslo et al.
5,054,280 A 10/1991 Ishibashi et al.
5,129,333 A * 7/1992 Frederick et al. ..... 110/235
5,201,181 A 4/1993 Ohmori et al.
5,393,220 A * 2/1995 Couwels et al. ..... 431/10
5,405,082 A * 4/1995 Brown et al. ..... 239/8
5,465,570 A 11/1995 Szillat et al.
5,490,380 A 2/1996 Marshall
5,617,718 A * 4/1997 Althaus ..... 60/39.17
5,687,571 A 11/1997 Althaus et al.
5,701,732 A * 12/1997 Nesbitt et al. ..... 60/776
5,749,219 A 5/1998 DuBell
5,836,164 A 11/1998 Tsukahara et al.
6,027,331 A 2/2000 Dobbeling et al.
6,055,813 A 5/2000 Keller et al.
6,076,356 A * 6/2000 Pelletier ..... 60/740
6,089,024 A 7/2000 Hatanaka
6,098,407 A * 8/2000 Korzendorfer et al. ..... 60/737
6,174,161 B1 * 1/2001 Slavejkov et al. ..... 431/159

(Continued)

OTHER PUBLICATIONS

Non-Final Office Action from U.S. Appl. No. 12/241,211 (Feb. 18, 2011).

(Continued)

*Primary Examiner* — William H Rodriguez
(74) *Attorney, Agent, or Firm* — Cermak Nakajima LLP; Adam J. Cermak

(57) ABSTRACT

A fuel lance (7) for introducing fuel into a gas flow in a combustor (1) of a gas turbine engine includes a region of the lance (7) through which the fuel is introduced into the gas flow having a generally helical formation (12).

14 Claims, 4 Drawing Sheets

U.S. PATENT DOCUMENTS

| | | | | |
|---|---|---|---|---|
| 6,202,399 | B1 * | 3/2001 | Frutschi | 60/773 |
| 6,270,338 | B1 | 8/2001 | Eroglu et al. | |
| 6,339,923 | B1 | 1/2002 | Halila et al. | |
| 6,349,886 | B1 * | 2/2002 | Bouti | 239/11 |
| 6,431,467 | B1 * | 8/2002 | Joshi et al. | 239/404 |
| 6,460,344 | B1 | 10/2002 | Steinthorsson et al. | |
| 6,539,724 | B2 * | 4/2003 | Cornwell et al. | 60/776 |
| 6,581,386 | B2 | 6/2003 | Young et al. | |
| 6,622,488 | B2 * | 9/2003 | Mansour et al. | 60/740 |
| 6,679,061 | B2 | 1/2004 | Steinbach et al. | |
| 6,832,482 | B2 | 12/2004 | Martling et al. | |
| 6,978,622 | B2 * | 12/2005 | Dittmann et al. | 60/782 |
| 7,082,770 | B2 | 8/2006 | Martling et al. | |
| 7,140,183 | B2 | 11/2006 | Ruck et al. | |
| 7,174,717 | B2 * | 2/2007 | Prociw | 60/740 |
| 7,185,497 | B2 | 3/2007 | Dudebout et al. | |
| 7,416,404 | B2 * | 8/2008 | Chan | 431/183 |
| 7,426,833 | B2 | 9/2008 | Yoshida et al. | |
| 7,454,914 | B2 * | 11/2008 | Prociw | 60/772 |
| 7,503,178 | B2 * | 3/2009 | Bucker et al. | 60/774 |
| 7,568,335 | B2 * | 8/2009 | Althaus | 60/39.17 |
| 7,568,345 | B2 * | 8/2009 | Furletov et al. | 60/742 |
| 7,762,070 | B2 * | 7/2010 | Dawson et al. | 60/740 |
| 7,908,842 | B2 * | 3/2011 | Eroglu et al. | 60/39.17 |
| 7,934,381 | B2 * | 5/2011 | Eroglu et al. | 60/740 |
| 7,950,239 | B2 * | 5/2011 | Lilley et al. | 60/774 |
| 7,992,808 | B2 * | 8/2011 | Micheli | 239/487 |
| 8,015,815 | B2 * | 9/2011 | Pelletier et al. | 60/740 |
| 8,020,384 | B2 * | 9/2011 | Pelletier et al. | 60/740 |
| 2006/0005542 | A1 | 1/2006 | Campbell et al. | |
| 2007/0107437 | A1 | 5/2007 | Evulet et al. | |
| 2007/0227155 | A1 | 10/2007 | Nemet et al. | |
| 2009/0211257 | A1 | 8/2009 | Cankovic et al. | |
| 2009/0293482 | A1 * | 12/2009 | Davis et al. | 60/737 |
| 2010/0071374 | A1 * | 3/2010 | Fox et al. | 60/734 |
| 2010/0077720 | A1 | 4/2010 | Poyyapakkam | |
| 2010/0077757 | A1 | 4/2010 | Poyyapakkam | |
| 2010/0205970 | A1 * | 8/2010 | Hessler et al. | 60/734 |

OTHER PUBLICATIONS

Office Action from co-pending U.S. Appl. No. 12/241,199 (Nov. 15, 2011).

Office Action from co-pending U.S. Appl. No. 12/241,211 (Sep. 22, 2011).

* cited by examiner

Fig. 2 (Prior Art)

FUEL LANCE FOR A GAS TURBINE ENGINE INCLUDING OUTER HELICAL GROOVES

BACKGROUND OF THE INVENTION

1. Field of Endeavor

The present invention relates to a fuel lance for introducing fuel into a gas flow in a combustor of a gas turbine engine, in particular a gas turbine with sequential combustion.

2. Brief Description of the Related Art

A gas turbine with sequential combustion is known to improve the efficiency of a gas turbine. This is achieved by increasing the turbine inlet temperature. In sequential combustion gas turbine engines fuel is combusted in a first combustor and the hot combustion gases are passed through a first turbine and subsequently supplied to a second combustor, known as an SEV combustor, into which fuel is introduced. The combustion of the hot gases is completed in the SEV combustor and the combustion gases are subsequently supplied to a second turbine.

The emissions regulations for gas turbines are, however, becoming ever more strict and ways are needed to maintain the efficiency of the gas turbine whilst reducing harmful emissions. In order to improve emissions, the processes occurring in the combustion chamber are of critical importance, in particular the mixing of the fuel with the oxidization gases. The conditions in the combustion chamber are particularly important when using hydrogen rich fuels, for example MBTU, which have a lower ignition delay time, higher adiabatic flame temperature and higher flame speed. These properties increase the tendency to produce harmful emissions, for example NOx. These high $H_2$ content fuels also have lower densities compared to conventional fuels such as natural gas, they therefore require a larger flow rate into the combustion chamber. The application of existing combustor designs to such fuels results in high emissions and safety problems. Existing combustor designs have a fuel lance for introducing the fuel into the hot gas flow. The fuel is introduced in either a radial or an axial direction. A problem encountered in these designs, especially with the use of hydrogen rich fuels, but also with more traditional fuels, is an uneven mixing in the 3D space and time resulting in higher emissions. The fuel jets are also orientated in such a way that the $H_2$-rich fuel reaches the burner walls far upstream of the exit of the mixing zone, whereby fuel residing close to the burner wall promotes undesirable auto ignition (i.e., premature ignition). Existing burner designs also do not allow multi-fuel injection without compromising on emissions or flashback safety.

Radially injecting a hydrogen rich fuel, such as MBTU, into an oncoming oxidization stream is problematic due to the blockage effect of the fuel jets (i.e., the stagnation zone upstream of the jet where the oncoming air stagnates), increasing local residence times of the fuel and promoting auto ignition. The shear stresses are highest for a fuel jet perpendicular to the main flow and the resulting turbulence may be high enough to permit upstream propagation of the flame.

SUMMARY

The present invention aims to address these problems. The present invention aims to provide a fuel lance for introducing fuel into a gas flow in a combustor of a gas turbine engine which improves the mixing of the fuel with the gas flow and hence increasing efficiency whilst reducing emissions.

According to one of numerous aspects of the present invention, a region of the fuel lance through which the fuel is introduced into the gas flow comprises a helical formation.

The helical formation in the region where fuel is introduced into the gas flow imparts swirl to the fuel, thereby enhancing the mixing of the fuel with the gas flow.

In a further preferred embodiment of the invention, the helical formation comprises a helical groove on the outer surface of the lance extending generally in the axial direction of the lance. A plurality of fuel outlets can be arranged on the surface of the helical groove and spaced apart in the axial and/or radial directions. A plurality of smaller fuel jets spaced apart in the axial and/or radial directions in combination with a helical groove imparting a circumferential component to the fuel jet improves the mixing of the fuel with the gas flow. The fuel diameter is chosen appropriately to get the desired momentum and jet penetration.

The above and other aspects, features, and advantages of the invention will become more apparent from the following description of certain preferred embodiments thereof, when taken in conjunction with the accompanying drawings.

BRIEF DESCRIPTION OF THE DRAWINGS

The invention is described referring to the embodiments depicted schematically in the drawings, and will be described with reference to the drawings in more details in the following.

The drawings show schematically in.

DETAILED DESCRIPTION OF EXEMPLARY EMBODIMENTS

Figure 2:
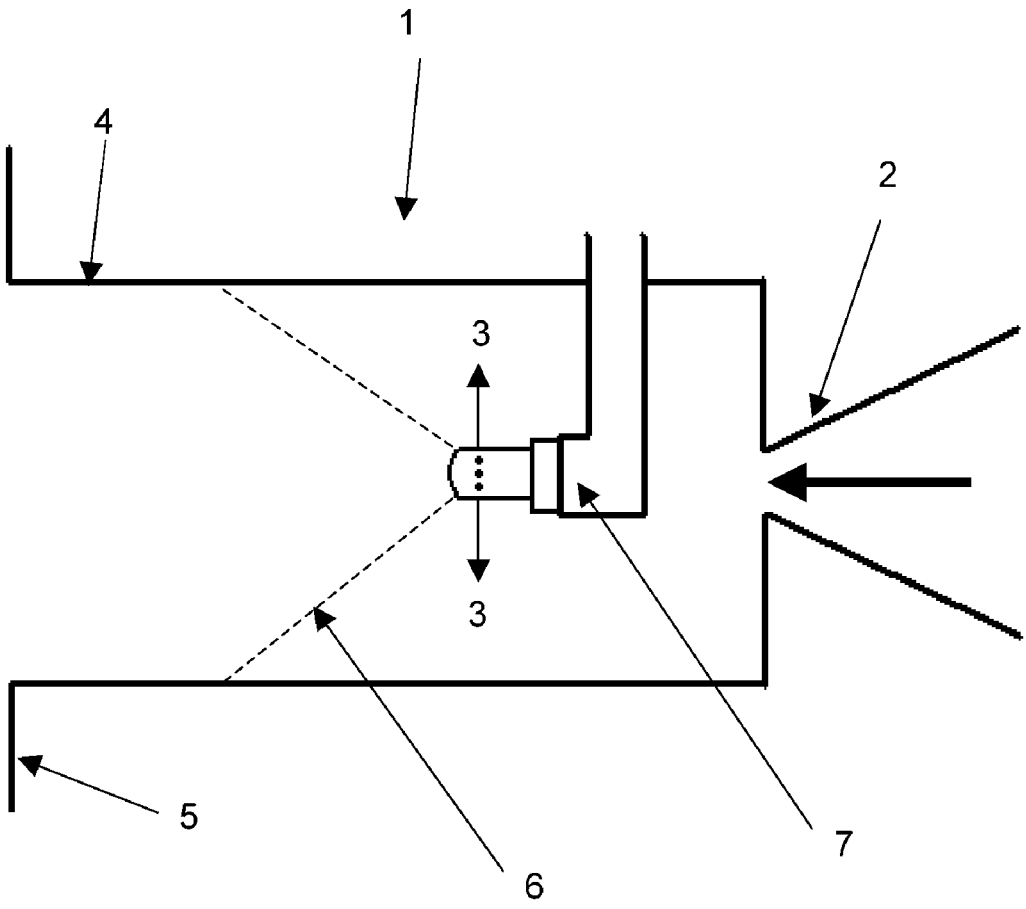

FIG. 2 schematically shows a state of the art combustion chamber 1 of a gas turbine engine. The combustion chamber is an SEV combustor forming part of a gas turbine with sequential combustion, whereby fuel is combusted in a first combustor and the hot combustion gases are passed through a first turbine and subsequently supplied to a second combustor, known as an SEV combustor 1, into which fuel is introduced. The hot combustion gases are introduced into the SEV combustor 1 through a vortex generator or generators 2. The combustion gases contain enough oxidation gases for further combustion in the SEV combustor. The SEV combustor 1 includes a fuel lance 7 projecting into the SEV combustor 1 for introducing fuel into the combustor 1. Fuel is injected radially (designated by arrow 3) from holes in the lance into the oxidization stream and interacts with the vortex/vortices created by the vortex generator 2. Particularly when using a hydrogen rich fuel such as MBTU, the fuel reaches the wall 4 of the combustor far upstream of the combustion front panel 5 as indicated by the dotted line 6 (in front of the dotted line represents a fuel air mixture, whereas behind the dotted line represents the oxidization gas only). The presence of fuel near the wall 4 promotes auto ignition (i.e., premature ignition).

Figure 1:
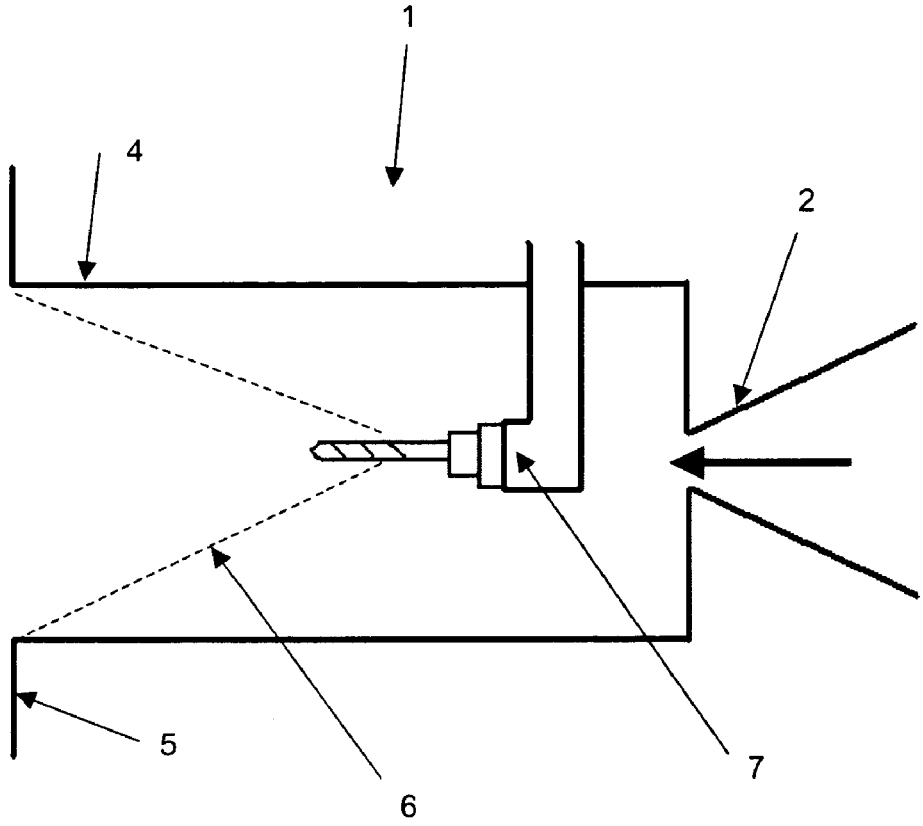
FIG. 1 a combustor of a gas turbine engine with a fuel lance according to the invention, FIG. 2 a fuel lance according to the state of the art, FIG. 3 a fuel lance according to a first embodiment of the invention, FIG. 4 a fuel lance according to a second embodiment of the invention.

FIG. 1 schematically shows a combustor 1 of a gas turbine system. The combustion chamber may be an SEV combustor 1 forming part of a gas turbine with sequential combustion, whereby fuel is combusted in a first combustor and the hot combustion gases are passed through a first turbine and subsequently supplied to a second combustor, known as an SEV combustor 1, into which fuel is introduced. The oxidization gases are introduced into the SEV combustor 1 through a vortex generator or generators 2. The fuel lance 7 according to the invention is provided for introducing fuel into the combustor. The fuel lance 7 is designed to provide for better mixing of the fuel with the oxidization gas. The fuel lance 7 is also formed so as to prevent the fuel from reaching the wall 4 of the combustor 1 upstream of the combustion front panel 5, therefore avoiding auto ignition. The dotted line 6 once more represents the border between the upstream oxidization gas only area and the downstream fuel and oxidization gas mixture.

Figure 3:
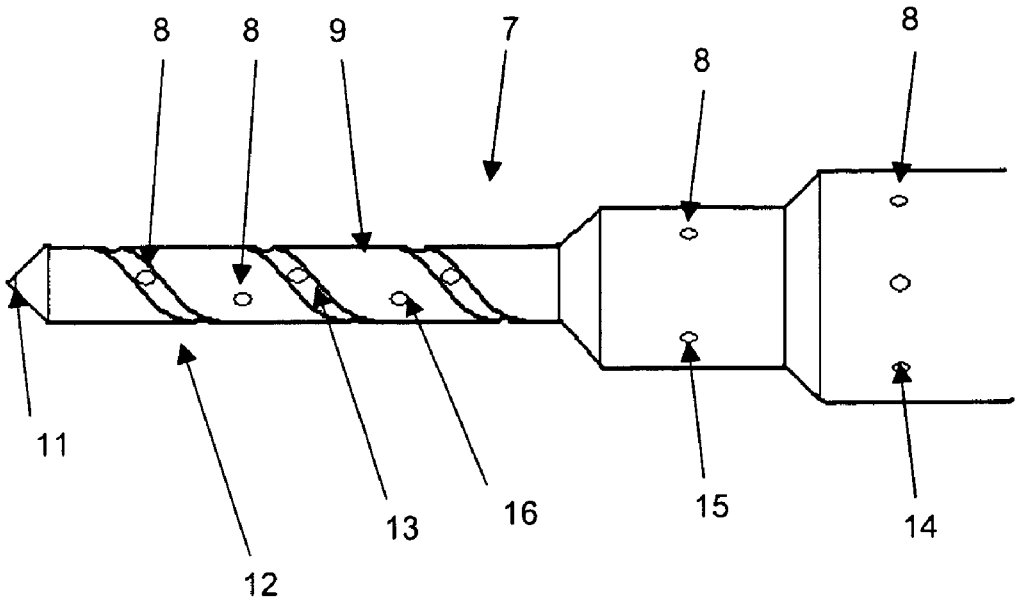

FIG. 3 shows one embodiment of a fuel lance 7 according to the invention. The fuel lance has fuel injector outlets 8. In order to achieve the desired distribution of fuel into the oxidization gas flow, the fuel lance 7 is provided with a helical or spiral formation 12. The helical or spiral formation 12 is arranged in a region of the lance where the fuel outlets 8 are situated. In the embodiment in FIG. 3 the helical formation is in the form of a groove 13 on the outer surface 9 of the fuel lance. At least one fuel outlet 8 is arranged in the groove 13. Preferably a series of fuel outlets 8 are arranged in the groove 13 and spaced in the axial direction. The fuel outlets 8 can also be arranged to be spaced in the circumferential directions. A series of smaller fuel injector outlets 8 provide a better fuel distributed than few, larger fuel injector outlets. The fuel injector outlets 8 which are arranged on the surface of the helical groove 13 may be directed in radial and/or axial directions. The fuel injector outlets 8 arranged on the surface of the helical groove 13 may also be directed in the direction of the groove, i.e., they could have an axial, radial, and circumferential/tangential component relative to the centre axis of the fuel lance 7. The helical formation improves the mixing of the fuel with the oxidization flow in the circumferential direction. This, combined with the vortex flow of the oxidization gas from the vortex generator 2, leads to a superior mixing effect. The spread of the fuel is also controlled by the swirl imparted to the fuel, thus improving flashback safety and reducing harmful emissions.

It should be understood that the helical formation 12 need not extend fully around the lance, for example a helical formation 12 extending sufficiently around the outer surface 9 of the lance 7 to impart a circumferential or tangential component to the fuel or the oxidization gas relative to the lance 7 may also be provided.

Figure 4:
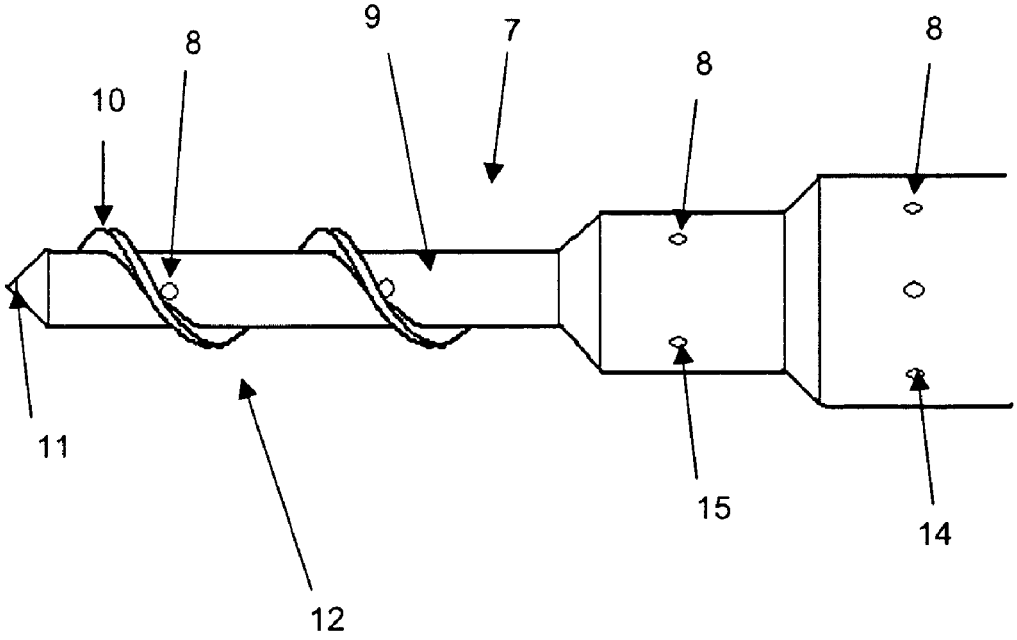

FIG. 4 shows another embodiment of the helical formation 12 which is provided by a projection 10 on the outer surface 9 of the fuel lance 7. Similar features are provided with the same reference numerals as for the features in FIG. 3.

The diameter of the lance need not remain constant. As shown in FIGS. 3 and 4, the fuel injector outlets 8 can be provided on the surface of the lance 7 at different radial distances from the centre axis. Fuel injected from a fuel injector outlet 14 at an outer radius and upstream of the other fuel outlets reaches the main oxidization flow furthest from the centerline. Fuel injected, however, from fuel injector outlets 15 at smaller radii and further downstream remains closer to the core of the flow. This staging effect also contributes to an improved mixing of the fuel with the oxidization flow. To achieve this effect, the lance could have other forms than the stepped form shown in FIG. 3. For example, the lance could be generally cone-shaped. The helical formation or formations could extend along the axial length of the cone.

The lance 7 could also be a multi-fuel lance capable of injecting, for example, a combination of oil, natural gas, syngas, or a hydrogen rich fuel such as MBTU. With reference to exemplary embodiments illustrated in FIGS. 5 and 6, the fuel lance 7 is provided with separate internal passages 17, 18, 19, for each fuel type. Each fuel can be injected into the oxidization gas flow at positions described above with reference to FIG. 3. Advantageously, the different fuels can be provided with fuel injector outlets at different positions on the fuel lance 7 corresponding to their particular fuel properties to achieve appropriate mixing with the oxidization gas flow. Advantageously the helical formation or groove 13 can be provided in the region where the natural gas or hydrogen rich fuel injector outlets are provided; the syngas is preferably introduced through fuel outlets 16 in the outer surface 9 of the fuel lance 7 (i.e., not in the region of the helical formation), whereas oil is preferably introduced through an outlet 11 of the lance tip.

Figure 6:
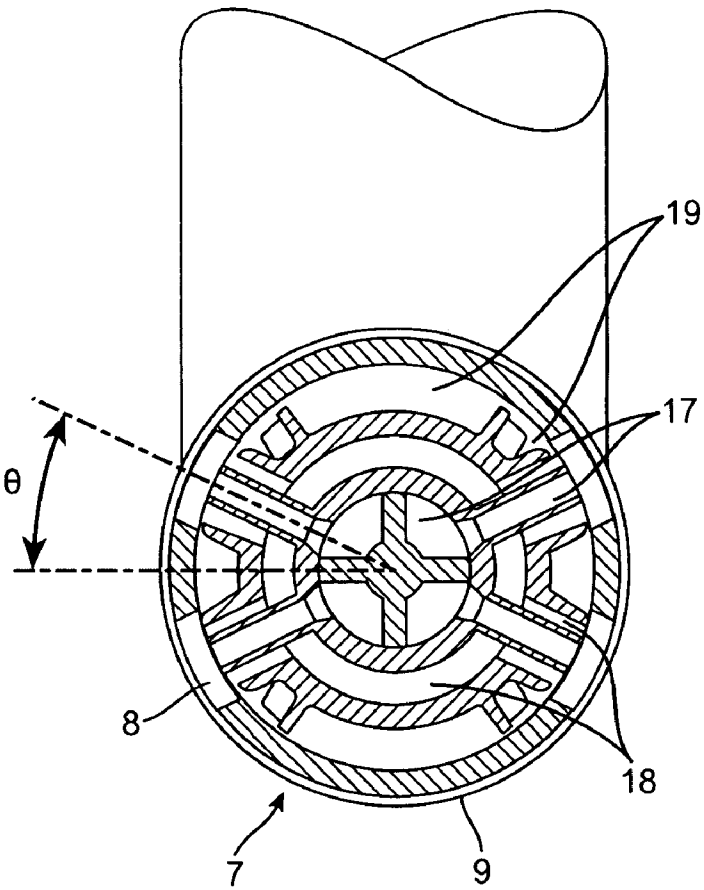
FIG. 6 a generally lateral cross-sectional view of the lance of FIG. 5.
Figure 5:
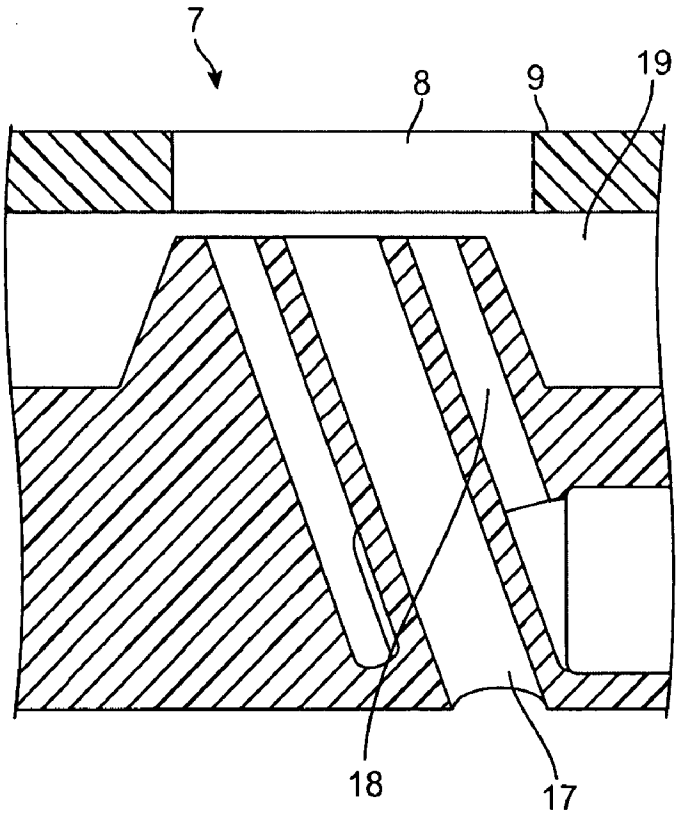
FIG. 5 a longitudinal cross-sectional view of a portion of a fuel lance.

Turning back to FIGS. 5 and 6, one or more fuels can be injected through the lance 7 through separate fuel passages 17, 18, 19, which extend longitudinally through the lance. As illustrated in FIG. 5, the passages 17, 18, 19 preferably isolate the fuel(s) until the distalmost portions of the passages, at which points the passages can empty into a common space for injection out of the lance, e.g., at the fuel outlet 8. Further optionally, the distalmost ends of one or more of the passages 17, 18, 19 can be oriented at one or more angles relative to the longitudinal axis of the lance 7 (FIG. 5), and/or at an angle $\theta$ relative to a plane extending through and including the longitudinal axis of the lance (FIG. 6). Further optionally, additional fuel and fuel passages can be provided through the lance 7, by fluidly sealing and subdividing apart portions of the passages 17, 18, 19 along portions of the length of the lance, as suggested by the cross-like seals separating the several portions of passage 17 in the center of FIG. 6.

A helical formation with an appropriate pitch for the combustor design should be chosen. The orientation of the helical formation can be chosen for optimal mixing; for example the formation can either run in the clockwise or anticlockwise directions, for example to either complement or contradict the direction of flow of the vortex flow of the oxidizations gases. Recirculation of the oxidization gas or fuel at the tip of the fuel lance can be prevented by providing a chamfered tip.

The diameter and number of the fuel injector outlets in the groove can also be chosen for a particular combustor design. The injector outlets can be in the form of holes or slots.

The cooling of the lance is provided by the fuel itself. The fuel supply passages are therefore suitably arranged to provide this effect.

The fuel lance 7 may be provided as a retrofitable fuel lance. In this way different fuel lances 7 can be provided with different fuel injector outlet configurations for varying injector requirements. The fuel lance 7 according to the invention enables the mixing of fuel and air which should be accomplished in the shortest possible residence time, which is an important requirement of a retrofit lance.

The fuel lance described herein may also be used in the combustor of a conventional gas turbine engine where compressed air is introduced into the combustor.

The preceding description of the embodiments according to the present invention serves only an illustrative purpose and should not be considered to limit the scope of the invention.

Particularly, in view of the preferred embodiments, different changes and modifications in the form and details can be made without departing from the scope of the invention. Accordingly the disclosure of the current invention should not be limiting. The disclosure of the current invention should instead serve to clarify the scope of the invention which is set forth in the following claims.

LIST OF REFERENCE NUMERALS

1. Combustor
2. Vortex generator(s)
3. Arrow
4. Combustor wall
5. Combustion front panel
6. Dotted line
7. Fuel lance
8. Fuel injector outlets
9. Outer surface
10. Projection
11. Fuel lance tip
12. Helical formation
13. Groove
14. Outlet
15. Fuel injector outlets
16. Fuel outlets
17. Fuel passage for a first fuel
18. Fuel passage for a second fuel
19. Fuel passage for a third fuel
θ Injection angle While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A fuel lance useful for introducing fuel into a gas flow in a combustor of a gas turbine engine, the lance comprising:
an elongate lance body including a generally helically shaped region through which fuel can be introduced into the gas flow, wherein the helically shaped region comprises a helical groove on the outer surface of the lance extending generally in the axial direction of the lance;
at least one fuel outlet configured and arranged to introduce fuel into the gas flow, positioned on the surface of the helical groove; and
wherein the at least one fuel outlet comprises a plurality of fuel outlets arranged on the surface of the helical groove and spaced apart in the axial and/or circumferential and/or radial directions.

2. A fuel lance according to claim 1, wherein a diameter of the fuel lance in a region where fuel is introduced into the gas flow is not constant in the axial direction.

3. A fuel lance according to claim 1, wherein the helically shaped region includes a projection on the outer surface of the lance extending generally in the axial direction of the lance.

4. A fuel lance according to claim 1, further comprising:
multiple fuel passages extending through the lance body, configured and arranged to introduce different fuels into the gas flow.

5. A fuel lance according to claim 4, further comprising:
a first fuel outlet in the surface of the groove and a second fuel outlet in the outer surface of the lance;
wherein the multiple fuel passages comprise a first fuel passage configured and arranged to supply a first fuel to the first fuel outlet and a second fuel passage configured and arranged to supply a second fuel to the second fuel outlet.

6. A fuel lance according to claim 1, further comprising:
a lance tip; and
a central passage configured and arranged to supply oil to the lance tip.

7. A fuel lance according to claim 1, wherein each of the plurality of fuel outlets comprises a hole or slot.

8. A fuel lance according to claim 1, wherein each of the plurality of fuel outlets is arranged so that fuel is introduced into the groove in an axial or radial direction.

9. A fuel lance according to claim 1, wherein each of the plurality of fuel outlets is arranged so that the fuel is introduced into the groove in a tangential direction.

10. A fuel lance according to claim 1, further comprising:
a hydrogen rich fuel flowing through the lance body and into the gas flow.

11. A gas turbine engine having sequential combustion, the engine comprising:
a first combustor configured and arranged to produce hot gas;
a second combustor downstream of the first combustor, configured and arranged to receive said hot gas from the first combustor; and
a fuel lance according to claim 1 in the second combustor, configured and arranged to introduce fuel into the hot gas.

12. A method of operating a sequential combustion gas turbine, the method comprising:
producing hot gas in a first combustor;
receiving said hot gas in a second combustor downstream of the first combustor; and
directly introducing fuel into the hot gas in the second combustor with a fuel lance according to claim 1, said hot gas flowing around the lance.

13. A method according to claim 12, further comprising:
receiving hot gas formed in the first combustor in a first turbine downstream of the first combustor and upstream of the second combustor; and
passing said hot gas from said first turbine to said second combustor.

14. A method according to claim 13, further comprising:
receiving hot gas formed in the second combustor in a second turbine downstream of the second combustor.

* * * * *